US005617675A

United States Patent [19]

Kobrehel

[11] Patent Number: 5,617,675

[45] Date of Patent: Apr. 8, 1997

[54] COLLAPSIBLE CABLE WINDOW REGULATOR

[75] Inventor: Michael D. Kobrehel, Elkhart, Ind.

[73] Assignee: Excel Industries, Inc., Elkhart, Ind.

[21] Appl. No.: 550,577

[22] Filed: Oct. 31, 1995

[51] Int. Cl.[6] ..... E05F 11/48

[52] U.S. Cl. ..... 49/352; 49/502; 49/506

[58] Field of Search ..... 49/352, 502, 349, 49/506

[56] References Cited

U.S. PATENT DOCUMENTS

| | | | |
|---|---|---|---|
| 2,501,092 | 3/1950 | Rappl | 49/352 X |
| 2,555,859 | 6/1951 | Rappl et al. | 49/352 |
| 4,110,935 | 9/1978 | Sessa . | |
| 4,158,270 | 6/1979 | Cherbourg et al. | 49/352 X |
| 4,235,046 | 11/1980 | Hess et al. | 49/352 |
| 4,592,245 | 6/1986 | Pickles | 49/352 X |
| 4,644,695 | 2/1987 | Shiraishi et al. | 49/352 |
| 4,910,917 | 3/1990 | Brauer . | |
| 5,074,077 | 12/1991 | Toyoshima et al. | 49/352 |
| 5,120,151 | 6/1992 | Farris et al. . | |
| 5,195,211 | 3/1993 | Krajenke . | |
| 5,263,282 | 11/1993 | Cooper et al. . | |
| 5,325,631 | 7/1994 | Lee et al. | 49/352 |

*Primary Examiner*—Philip C. Kannan
*Attorney, Agent, or Firm*—Banner & Witcoff, Ltd.

[57] ABSTRACT

A collapsible cable regulator assembly is provided, having a collapsible support structure wherein one or more swing arms are pivotably mounted to a lateral member. Cable guide means are provided for mounting a regulator cable, including a cable return at the free end of each of the swing arms. The collapsible support structure is openable from a collapsed condition in which each swing arm is at an acute angle to the lateral member, to an operating condition in which each swing arm is at an operating angle to the lateral member which is greater than the aforesaid acute angle. The cable regulator assembly in its collapsed condition has improved installation capability, being especially advantageous for installation through limited access openings. Once in proper location, the cable regulator assembly is opened to its operating condition. The regulator assembly can then be permanently or non-permanently mounted in position, and a windowpane or other moveable member attached to mounting brackets or gliders driven by the regulator cable. In the operating position the swing arms act as guide rails with good parallelism aided by the lateral member acting as an interconnecting cross-member between the guide rails.

20 Claims, 5 Drawing Sheets

COLLAPSIBLE CABLE WINDOW REGULATOR

FIELD OF THE INVENTION

The present invention is directed to a cable regulator assembly suitable for controlling the position of a window pane in a motor vehicle door window opening. More particularly, the invention is directed to a collapsible cable regulator assembly.

BACKGROUND

Cable regulator assemblies are well known, typically having a drive cable mounted onto one or more cable guides and driven by suitable drive means, for example, a drive drum mounted for reversible rotation by a hand crank, electric motor or the like. The drive cable is attached to a driven member at one or more locations, such that the position of the driven member can be controlled by actuating the drive means to controllably drive the cable. Cable regulators are widely used for controlling the position of a window pane, for example, a window pane vertically mounted in the window opening of a motor vehicle door. Exemplary cable window regulator assemblies for use in motor vehicles are shown in U.S. Pat. No. 4,910,917 to Bauer, entitled Bowden Cable Equipped Window Lift, and in earlier U.S. Pat. No. 4,110,935 to Sessa, entitled Cable-Actuated Car-Side-Window-Lifting Mechanism. Typically, the window pane is carried by one or more brackets fixedly attached to the cable.

Regulator assemblies in which a single carrying bracket is used may provide inadequate stability to the window, allowing it to rock or rotate in its lifting plane due to uneven edge resistance as the window pane is being raised or lowered. It is known that improvement can be obtained by dual mounting brackets attached to the window pane at spaced locations along its bottom edge, and each fixedly attached to the drive cable. Both the aforesaid Sessa patent and Bauer patent show regulator assemblies employing dual mounting brackets. The advantages of dual guide rails for motor vehicle window regulators are recognized, for example, in commonly owned U.S. Pat. No. 5,398,449 to Kobrehel et at, entitled Window Regulator for a Frameless Door Assembly.

Significant difficulties have been experienced, however, using cable regulator assemblies having such dual mounting brackets if the brackets are not lifted and lowered along precisely parallel paths. The Bauer patent suggests designs to correct or compensate for misalignment of the guide rails along which two window pane mounting brackets travel. The two guide rails are mounted separately in a vehicle door, and the compounding of manufacturing tolerances and assembly variability leads to lack of adequate parallelism of the two guide mils. Consequently, the Bauer patent suggests that only one mounting bracket be rigidly fixed to the window pane while the other employs a mounting slot or eccentric cam to accommodate such misalignment, leading to reduced window pane stability.

Alternative cable regulator designs present significant assembly disadvantages. The structural members of a vehicle door forming the door cavity in which the regulator assembly is to be mounted, typically prevent installation into the cavity of a pre-assembled cable regulator assembly. In addition, the typically small working area within the door cavity and its limited access from the outside inhibit assembly inside the door cavity.

It is an object of the present invention to provide a cable regulator assembly having improved installation capability. It is a further object of the invention to provide a regulator assembly which at least in preferred embodiments provides dual guide rails interconnected by a rigid joining member for improved parallelism between the guide rails, and yet which has the aforesaid improved installation capabilities. Additional objects and features of the invention will become apparent from the following disclosure taken together with the detailed discussion of certain preferred embodiments.

SUMMARY

The present invention provides a unique collapsible cable regulator assembly which, as discussed further below, may lock or otherwise mount permanently into place upon installation. Hence, it may be collapsible perhaps only in the sense of being assembled initially in a collapsed condition for insertion into a motor vehicle door or other installation, after which it is opened, permanently or otherwise, to an operating condition.

In accordance with a first aspect, the collapsible cable regulator assembly has a collapsible support structure comprising an elongate, rigid joining member and an elongate swing arm adapted to form a guide rail pivotably mounted at one end to the joining member. Preferably, the support structure has a second swing arm also forming a guide rail, which cooperates with the first swing arm and the joining member to form a U-shaped structure. In preferred embodiments, the first and second swing arms are pivotably mounted at opposite ends of a ridged joining member, being collapsible toward each other to positions mutually overlapping each other and the joining member. The swinging arms of such preferred embodiments are openable to fixed positions having precise and maintainable parallelism. The support structure also has one or more cable guides, including at least a cable return, preferably an idler pulley, at the free end of each swing arm. The collapsible support structure can be opened from a collapsed condition in which the swing arms are at an acute angle to the joining member, preferably being substantially parallel thereto, to an operating condition. In the operating condition the swing arms are at a greater angle to the joining member, typically being approximately perpendicular thereto. A regulator cable is mounted to the collapsible support structure. In preferred embodiments, as discussed further below, tensioning means are provided to take up slack in the regulator cable, most notably slack occurring upon movement of the swing arm between the collapsed position and the operating position.

Those skilled in the an will recognize that cable regulator assemblies as disclosed here can provide the advantages of dual guide rails with precise and robust parallelism, together with improved installation capabilities. The dual guide rails, in the form of pivotably mounted swing arms, can be preassembled to the joining member, and put into its collapsed position for ready installation into a limited access location, such as the cavity of a motor vehicle door or the like. Once within such a limited access area, the swing arms are moved to their open position, with the regulator cable premounted onto the resulting U-shaped support structure. Such method of installing a window regulator assembly is a second significant aspect of the invention and will be discussed further below in connection with certain preferred embodiments.

From the foregoing disclosure and the following more derailed discussion of certain preferred embodiments, it will be apparent to those skilled in the art, that is, those who are knowledgeable and experienced in this area of technology, that the present invention is a highly significant advance in the technology. In the context of a motor vehicle window application, for example, mounting brackets or "gliders" driven by the regulator cable up and down along the guide rails can be secured to the window pane proximate its forward and rearward edges. Taken together with the good parallelism afforded in large measure by the lateral joining member between the guide rails, such so-called edge drive arrangements are found to provide excellent operating performance, including window pane stability with a reduction or elimination of the window pane jamming in its peripheral guide tracks. It will be recognized to be particularly significant that such features and performance improvements are achieved by means of a cable regulator assembly which can be preassembled, with consequent cost and assembly complexity reduction, and yet which has good installation capability even into areas having restricted access, such as certain motor vehicle door cavities and the like. The parallelism of the swing arms, acting as guide rails for the gliders to which the window pane is mounted, aids in maintaining the correlative parallelism of the gliders. In accordance with preferred embodiments, therefore, the gliders can be rigidly mounted to the glass with good three-dimension positional control and stability. The improved positioning stability in an edge drive arrangement employing two gliders synchronized in vertical movement on the swing arms of a collapsible cable regulator assembly as disclosed here, which swing arms have been moved into position as vertical guide rails within a vehicle door cavity, can in preferred embodiments provide sufficient positional stability as to permit deletion of certain previously required componentry. For example, in certain preferred embodiments glass run channels may be deleted, providing improved design flexibility. In addition, the felted or flocked bumpers referred to by some in the industry as "boxing gloves" and used to keep a window pane stable in its vertical movement may also in some cases be deleted. Corresponding advantages are thereby achieved in both componentry cost and assembly cost and complexity.

Additional features and advantages of the invention will be apparent from the following detailed description of certain preferred embodiments.

BRIEF DESCRIPTION OF THE DRAWINGS

Certain preferred embodiment are discussed below with reference to the appended drawings wherein.

Figure 1:
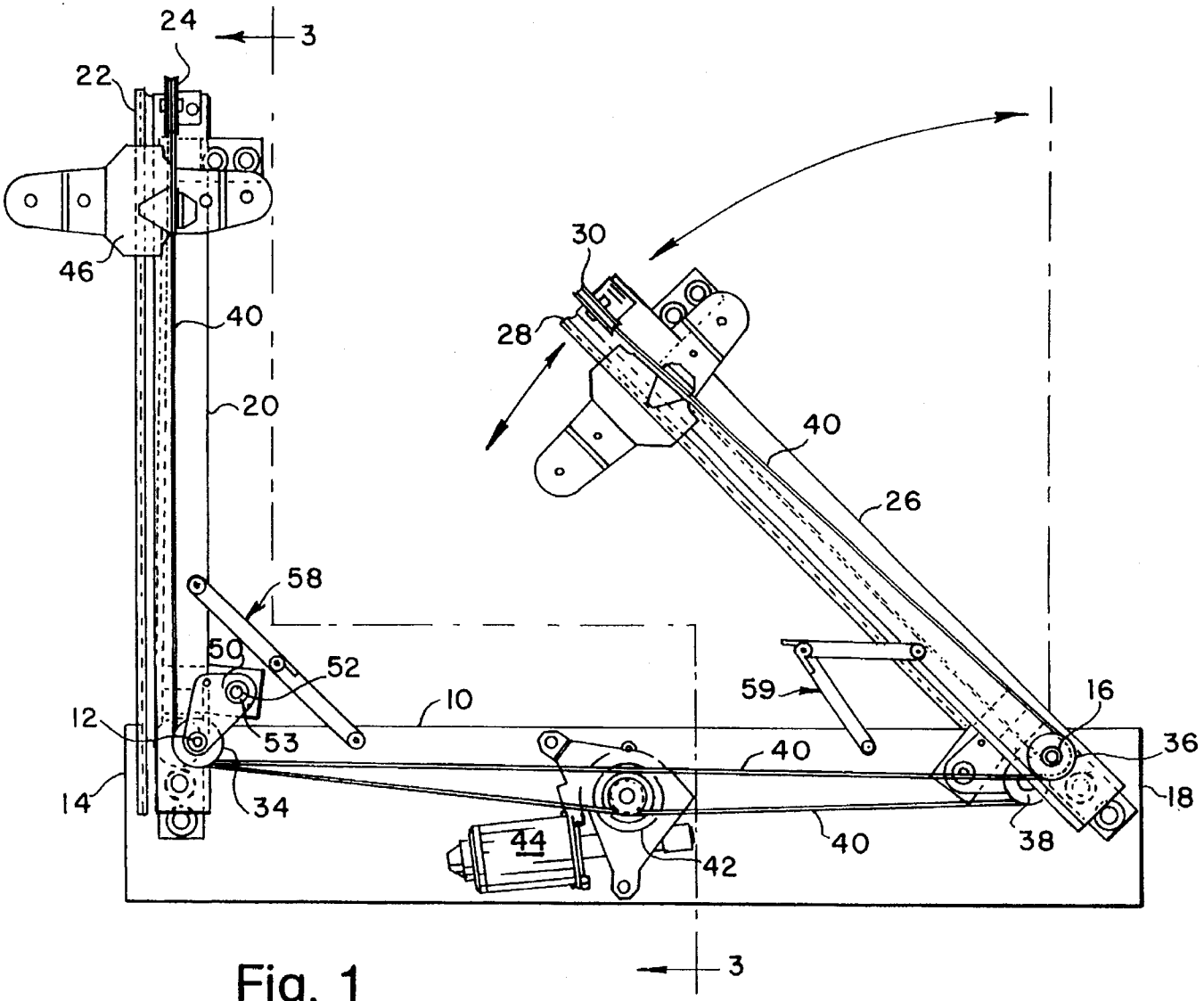
FIG. 1 is a schematic elevation view of a collapsible cable regulator assembly in accordance with a first preferred embodiment, shown in a partially open or operating condition.

It should be understood that the appended drawings are not necessarily to scale, presenting a somewhat simplified representation of certain preferred embodiments illustrative of the basic principals of the invention. The specific design of collapsible cable regulator assemblies in accordance with the invention, including for example, the specific configuration and dimensions of various components, will be determined in part by the intended application and use environment of the regulator assembly. Certain features of the regulator assembly depicted in the appended drawings have been enlarged or distorted relative to others to facilitate visualization and clear understanding. In particular, thin features may be thickened, for example, for clarity of illustration.

All references to direction and position, unless otherwise indicated, refer to the orientation of the regulator assemblies illustrated in the drawings. It should be understood, however, that collapsible cable regulator assemblies in accordance with the invention can be used in diverse applications and in any position or orientation, including for example, for either vertical or horizontal movement control. In that regard, the discussion below involves application of collapsible cable regulator assemblies of the invention for controlling vertical movement of window panes mounted in the window opening of motor vehicle doors. While the invention is especially advantageous in such applications, both for its enhanced installation capability and its excellent edge drive performance characteristics, those skilled in the art will recognize from this disclosure numerous additional applications for which the collapsible cable regulator assemblies of the invention are suitable.

DETAILED DESCRIPTION OF CERTAIN PREFERRED EMBODIMENTS

Figure 2:
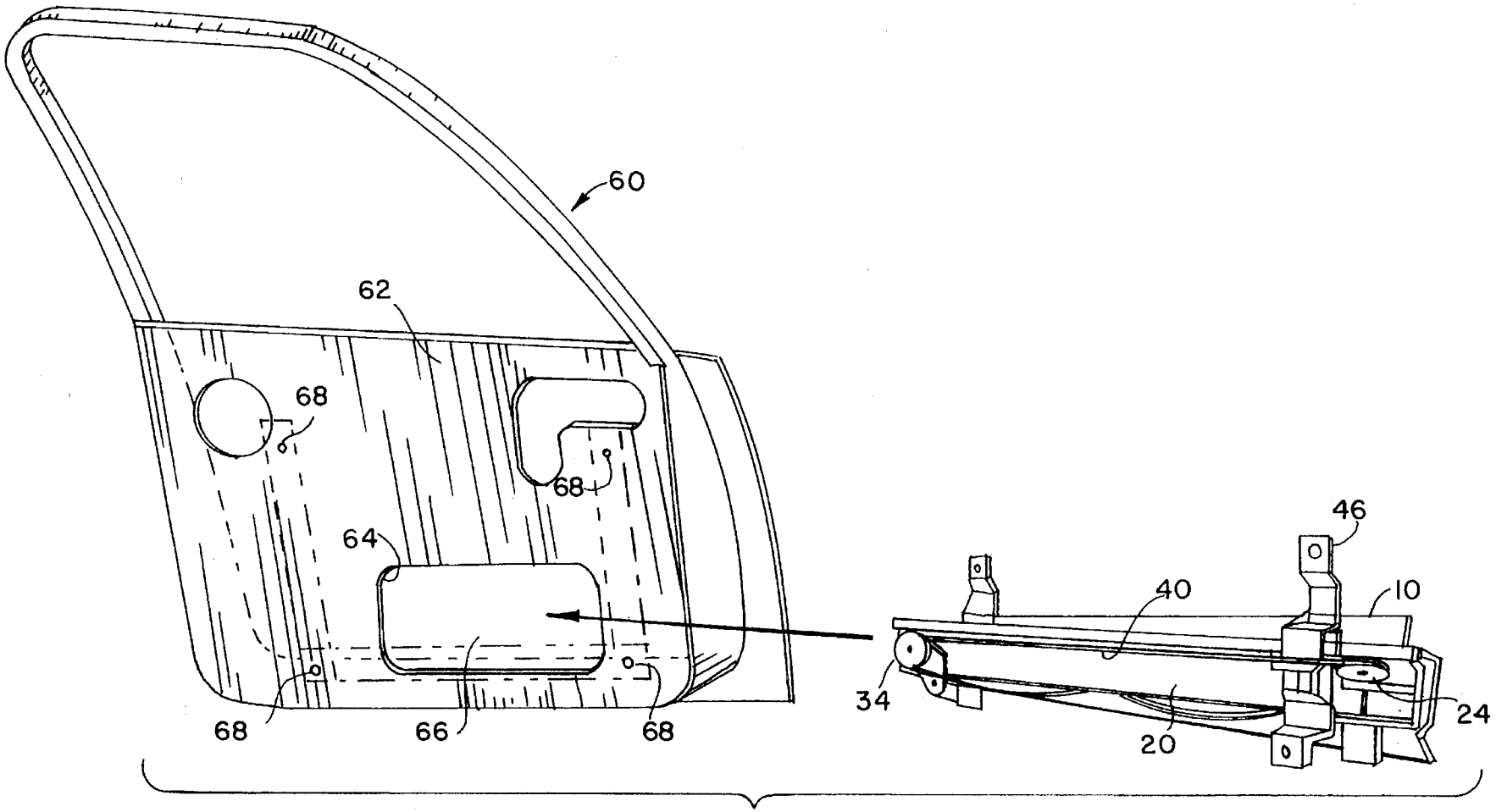
FIG. 2 is an exploded view of the collapsible cable regulator assembly of FIG. 1 in its closed or collapsed condition, prepared for installation into the cavity of a motor vehicle door through a restricted access opening in the inside wall of the door.

The preferred embodiment of a collapsible cable regulator assembly illustrated in FIGS. 1–5 is suitable for use in controlling a moveable windowpane to open and close a window opening in a motor vehicle door. The regulator assembly has a collapsible support structure, that is, a support structure having an open or operating condition, as illustrated in FIG. 1, and a closed or collapsed position, as illustrated in FIG. 2. The support structure includes an elongate lateral member 10 having a first pivot mounting point 12 at left end 14 (as viewed in FIG. 1) and a second pivot mounting point 16 at its right end 18. The pivot mounting points need not be at the extreme ends of lateral member 10. Since the cable regulator assembly illustrated is adapted for a preferred edge drive application, the pivot mounting points are widely laterally spaced. Nevertheless, lateral member 10 may extend at one or both ends beyond the pivot mounting points to facilitate mounting of the regulator assembly inside the door cavity. Reference here to the lateral direction or lateral spacing means fight-to-left as viewed in FIG. 1. Thus, the lateral direction for a cable regulator of the invention used in a door cavity of a typical side door in a motor vehicle will usually be the fore-and-aft direction of the vehicle. Lateral member 10 preferably is substantially ridges with stable longitudinal dimension, most preferably being formed of stamped steel or other rigid material suitable for a motor vehicle application. A first elongate swing arm 20 is pivotably mounted to lateral member 10 at the first pivot mounting point 12. It extends upwardly (in the open condition as illustrated in FIG. 1) to a free end 22 at which a first cable return 24 is mounted. A second elongate swing arm 26 is pivotably mounted to lateral member 10 at the second pivot mounting point 16. It extends to a free end 28 at which a second cable return 30 is mounted. The swing arms preferably are formed of stamped sheet steel or other sufficiently rigid and durable material suitable for motor vehicle applications.

Figure 3:
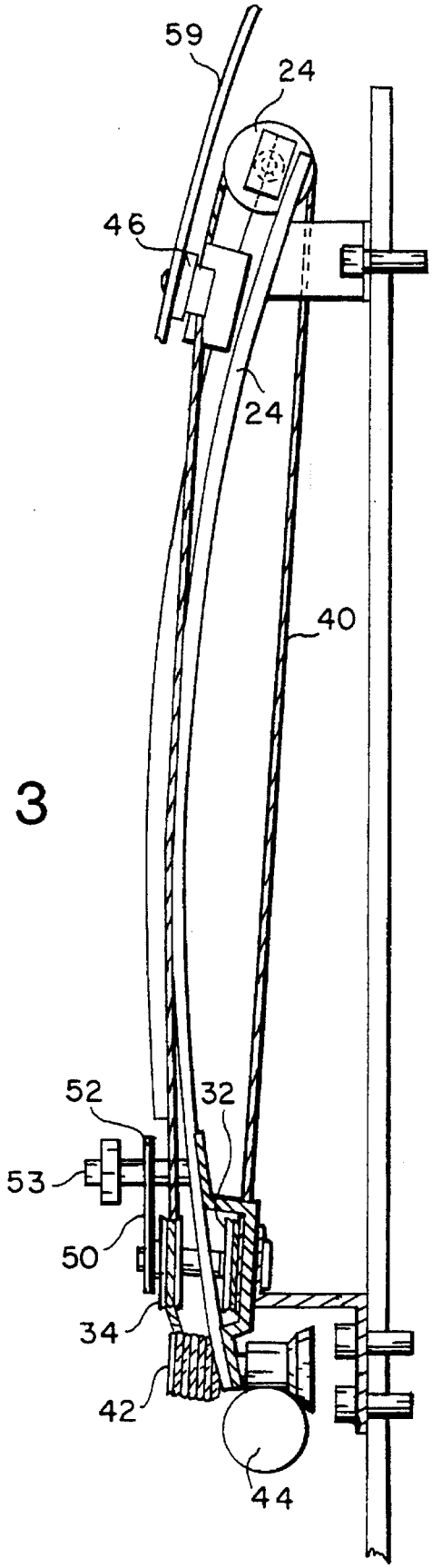
FIG. 3 is a side elevation view, partially in section, taken through line 3—3 of FIG. 1.

A pair of cable guides 32, 34 are mounted at the lower end of first swing arm 20. Similarly, a pair of cable guides 36, 38 are mounted at the lower end of second swing arm 26. The cable returns and cable guides all preferably are idler pulleys mounted for free-wheeling rotation. Various alternative cable guides will be apparent in view of this disclosure, including, for example, curved fixed surfaces, cable sheathing, etc. As best seen in FIG. 3, cable guides 32 and 34 are mounted to the swing arm 20 for rotation about a common axis (when the regulator is in the open or operating condition) which passes through the second pivot mounting point 12. A corresponding arrangement is provided for cable guides 36, 38 of the second swing arm 26. A regulator cable is mounted to the collapsible support structure and drive means are provided for driving the regulator cable. Specifically, regulator cable 40 extends from driven engagement with a cable drive drum 42 around the first and second cable returns 24, 30, with turning points at the cable guides 32, 34, 36, 38. In the illustrated embodiment, significant advantages are achieved by the upwardly open U-shaped support structure, especially taken in conjunction with the corresponding U-shaped cable routing. Specifically, by moving the structural members of the regulator assembly to the periphery of the door cavity, the center area is left clear for other components. Structural foam, anti-intrusion beams, etc. are therefore better accommodated. In addition, the high mass items of the regulator assembly, such as the electric motor, etc, are advantageously removed from the impact zone. Thus, the lateral member preferably is mounted in the door cavity proximate the structural door components forming the bottom of the door cavity. The swing arms preferably are mounted proximate the front and back of the door cavity. By routing the regulator cable along the lateral cross-member, i.e., following the upwardly open U-shaped structure of the regulator assembly, the further advantage is achieved of providing significant protection to the cable.

The cable drive drum can be driven by hand crank, electric motor, etc. Suitable devices and arrangements for powering the drive drum are known and will be readily adaptable to the collapsible cable regulator assemblies disclosed here with the aid of the present disclosure. In the illustrated embodiment, drive drum 42 is driven by electric motor 44. In accordance with certain preferred embodiments, drive drum 42 may have a variable drum diameter in accordance with the disclosure of presently pending, commonly owned U.S. patent application Ser. No. 08/369,718, the disclosure of which is incorporated herein by reference. In such embodiments, the operating surface of the drive dram about which the cable 40 is wrapped one or more times has a diameter which varies either continuously or in a step-wise fashion. Cable tensioning means are used, generally, in cable regulator assemblies having variable diameter drive drums. Advantageously, preferred embodiments of the cable regulator assemblies disclosed here incorporate tensioning means, as discussed further below, to accommodate cable slackness upon moving between the collapsed and operating condition. Thus, variable diameter cable drive drums are readily accommodated.

A first windowpane mounting bracket or glider 46 is attached to the regulator cable 40 for vertical travel along swing arm 20 acting as a first guide rail. Similarly, a second glider 48 is attached to cable 40 for vertical travel along the second swing arm 26 acting as a second guide rail. Suitable configurations for gliders 46 and 48 are well known and will be apparent to those skilled in the art in view of the present disclosure. Actuation of drive drum 42 drives cable 40, such that the gliders 46, 48 travel up and down in unison, thereby raising and lowering a windowpane 59 (shown only in FIG. 3) mounted to the gliders. As discussed above, lateral member 10, acting as a structural cross-member between the two vertical guide rails, aids in insuring the parallelism of the guide rails. Thus, in accordance with the preferred embodiment illustrated, the gliders travel in sufficiently precise parallel paths as to permit rigid attachment of a windowpane to both gliders. In this way, good three dimensional stability is achieved in the position and orientation of the windowpane, with consequent improvement in window performance characteristics.

Figure 5:
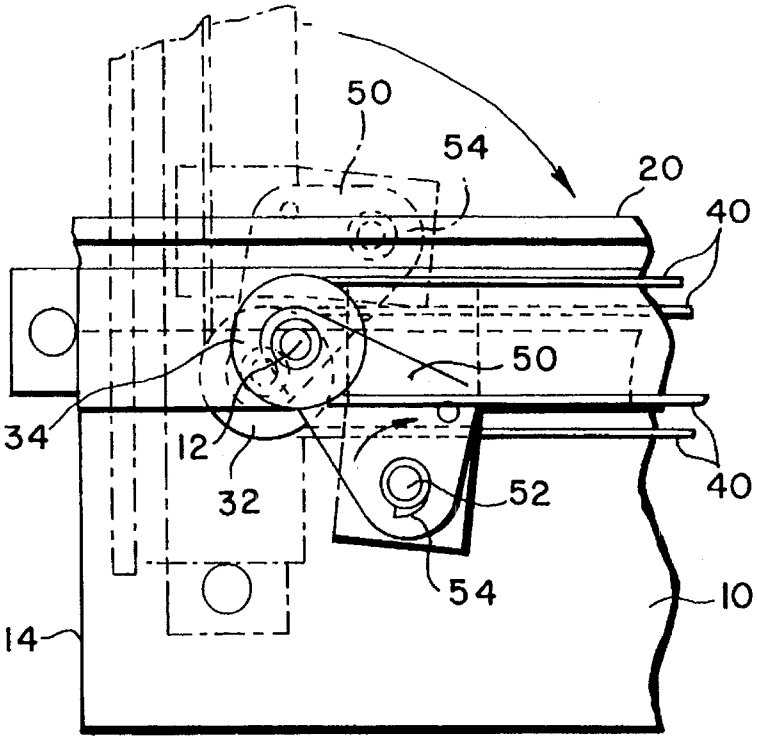
FIGS. 4 and 5 are enlarged perspective views of the swing arm pivot area of the collapsible cable regulator assembly of FIGS. 1–3, shown in the open condition and closed condition, respectively.
Figure 4:
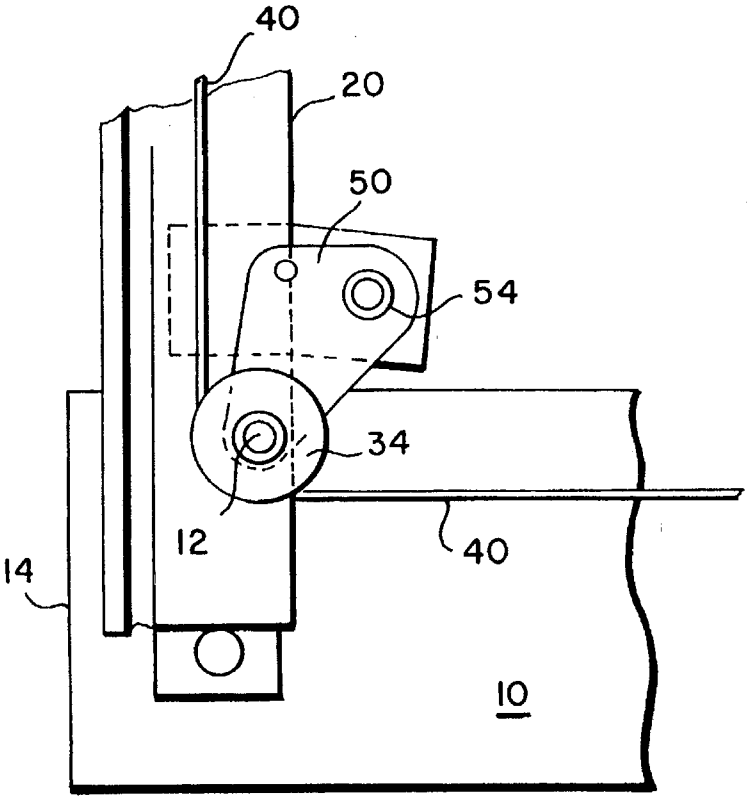
Figure 6:
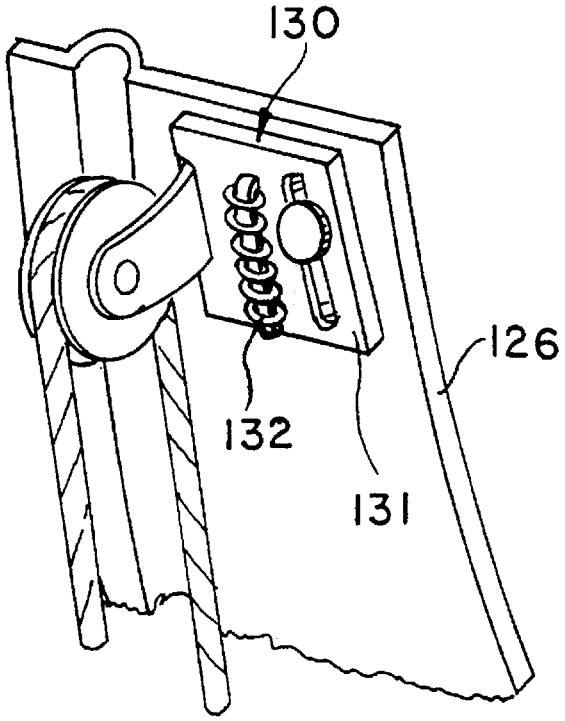
FIG. 6 is an enlarged perspective view of the free end of a swing arm of a collapsible cable regulator assembly in accordance with an alternative preferred embodiment.

A certain slackening of the regulator cable typically will occur in moving the collapsible support structure between its collapsed condition and its operating condition. The amount of slack cable will depend in pan on the position and orientation of the cable guides located at the lower end of the swing arms proximate the pivot mounting points. Preferably the cable guides are pulleys mounted on a common axis of rotation passing through the respective pivot mounting point. In that case, the cable slackness generated at each side will be equal to approximately one-quarter of the circumference of the pulley wheels. Accordingly, cable tensioning means are provided in the preferred embodiment illustrated in FIGS. 1–5. Specifically, a spring biased idler arm is provided for one of the two cable guides at the base of each swing arm. The two idler arms preferably are substantially mirror images of each other, and the description here with reference to FIGS. 4 and 5 is limited for simplicity to the idler arm provided at the base of first swing arm 20. FIG. 4 shows swing arm 20 in its operating position, while FIG. 5 shows it in the collapsed position. Idler arm 50 is pivotably mounted to swing arm 20 at pivot point 52 by pivot pin 53. It positions cable guide 34 in coaxial alignment with cable guide 32 when the cable regulator assembly is in its operating condition, as in FIG. 4. It is biased into this position by spring 54. When the regulator assembly is in its collapsed condition, as in FIG. 5, the biasing force of spring 54 is overcome as idler arm 50 is deflected from its operating position to accommodate an effective loss of cable length due to the regulator cable being wrapped around cable guide 34 approximately an additional 45°. Thus, in the collapsed condition, cable guide 34 is no longer in coaxial alignment with cable guide 32. In view of the present disclosure, suitable additional or alternative tensioning means will be apparent to those skilled in the art. In the alternative embodiment illustrated in FIG. 6, cable return 130 is on a mounting plate 131 which is mounted to a swing arm 126, for movement between a first position closer to the lateral member and a second position further from the lateral member. Tensioning means for taking up slack in the regulator cable comprises a spring 132 biasing the mounting plate toward the second position, that is, away from the lateral member.

As mentioned above, the cable guides at the base of each of the two swing arms preferably are idler pulleys mounted on a common axis, and the corresponding cable return at the top of the swing arm is an idler pulley mounted for rotation in a plane 90° rotated from that of the lower cable guides. That is, in this preferred embodiment, the front cable return in a free-wheeling pulley mounted for rotation in a plane substantially perpendicular to the U-shaped cable support structure, and the front cable guides are free-wheeling pulleys in approximate vertical alignment with the front cable return, mounted on a common axis of rotation (in the operating condition) which is substantially normal to the plane of the U-shaped cable support structure. Similarly, the rear cable return is a free-wheeling pulley mounted for rotation in a place substantially perpendicular to the U-shaped cable support structure, and the rear cable guides are freewheeling pulleys in approximate vertical alignment with the rear cable return, with a common axis of rotation (in the operating condition) which is substantially normal to the plane of the U-shaped cable support structure. The guide channels in a further advantageous aspect, each acts as a mounting bracket for the upper cable return and/or the lower cable guides, resulting in excellent reduction of componentry and simplification of assembly. In addition, the rotation or twist of the cable return at the free end of the swing arm provides good design flexibility to the regulator assembly, permitting, for example, lateral adjustment of the free end of the swing arm (to the right and left as viewed in FIG. 1 ) to precisely position or "tune" the angle of the guide channel in the installed position. While in the preferred embodiment illustrated the cable guides are pulleys mounted to the swing arm, suitable alternative cable guide arrangements will be apparent in view of the present disclosure.

As best seen in FIG. 2, the cable regulator assembly in its collapsed condition is substantially more compact than in its operating condition. First and second swing arms 20, 26 pivot toward each other such that in the fully collapsed position they substantially overlap each other and the lateral member 10. It will be appreciated in view of the present disclosure that the precise degree of collapse for which the regulator assembly is designed will depend in large measure on the particular application for which it is intended. The regulator assembly typically may be designed to collapse only to a degree sufficient to enable its installation through whatever limited access opening is available in the particular application. In FIG. 2 a motor vehicle door 60 is seen to have an inside wall 62. A relatively small opening 64 in wall 62 provides limited access to door cavity 66. The cable regulator assembly can be seen to be adequately collapsed for installation into door cavity 66 through opening 64. Once inside door cavity 66, swing arms 20 and 26 are readily moved into their open position. The regulator assembly can then be fixedly mounted to the door 60, for example, by means of bolts or the like attached to the regulator assembly through mounting holes 68 in the inner wall 62.

Preferably mechanical stops or other limiter means are provided for correctly positioning the swing arms relative the lateral member in the operating condition. Such mechanical stops may comprise, for example, a flange, stud or other integral projection of the lateral member 10. The integral projection may form a snap fit, with a corresponding detent in the swing arm, for example. In certain alternative preferred embodiments, the mechanical stop or other limiter means locks the swing arm in proper position. The swing arms may be locked either releasably or non-releasably in their correct position, depending on the desirability of re-collapsing the regulator assembly at a future time for removal or other purposes. In the preferred embodiment illustrated in FIGS. 1–5, the cable regulator assembly limiter means in the form of a first bi-fold bracket 58 between the lateral member 10 and the front saving arm 20 and a second bi-gold bracket 59 between the lateral member 10 and the rear swing arm 26. Numerous alternative suitable designs for the limiter means will be apparent to those skilled in the art in view of the present disclosure.

It will be apparent from the foregoing discussion that numerous alternative embodiments exist within the true scope and spirit of the present invention. The appended claims are intended to cover all such alternative embodiments.

I claim:

1. A collapsible cable regulator assembly comprising, in combination:

a) a collapsible support structure comprising
an elongate lateral member,
an elongate first swing arm having a free end and a mounted end which is pivotably mounted at a first pivot point to the lateral member, and
cable guide means, including a cable return at the free end of the swing arm, the collapsible support structure being openable from a collapsed condition in which the swing arm is at an acute angle to the lateral member to an operating condition in which the swing arm is at an operating angle to the lateral member which is greater than the acute angle;

b) a regulator cable mounted to the collapsible support structure; and c) tensioning means for taking up slack in the regulator cable.

2. The collapsible cable regulator assembly in accordance with claim 1, wherein the cable return is on a mounting plate which is mounted to the first swing arm for movement between a first position closer to the lateral member and a second position further from the lateral member, and the tensioning means comprises a spring biasing the mounting plate toward the second position.

3. The collapsible cable regulator assembly in accordance with claim 2, wherein the mounting plate is longitudinally slidable on the first swing arm.

4. The collapsible cable regulator assembly in accordance with claim 1, wherein the cable guide means further comprises a cable guide mounted proximate the first pivot point on a moveable mounting plate attached to the first swing arm and moveable between a first position and a second position, and the tensioning means comprises a spring biasing the mounting plate toward the second position.

5. The collapsible cable regulator assembly in accordance with claim 1, further comprising drive means for driving the regulator cable.

6. The collapsible cable regulator assembly in accordance with claim 5 wherein the drive means comprises a rotatable drive drum mounted at the longitudinal member and carrying at least one wrap of the regulator cable.

7. The collapsible cable regulator assembly in accordance with claim 6 wherein the drive means further comprises an electric motor mounted to the lateral member and having a reversibly rotatable output member operatively connected to the drive drum.

8. The collapsible cable regulator assembly in accordance with claim 1, wherein the collapsible support structure further comprises a second swing arm having a free end and a mounted end which is pivotably mounted to the lateral member at a second pivot point which is laterally spaced from the first pivot point, the second swing arm being at an acute angle to the lateral member in the collapsed condition of the collapsible support structure and at an operating angle greater than the acute angle when the collapsible support structure is in the operating condition.

9. The collapsible cable regulator assembly in accordance with claim 8 wherein the collapsible support structure is substantially U-shaped in the operating condition.

10. The collapsible cable regulator assembly in accordance with claim 8 wherein the collapsible support structure further comprises limiter means for correctly angling the first and second swing arms relative the lateral member in the operating condition.

11. The collapsible cable regulator assembly in accordance with claim 10 wherein the first and second swing arms are releasably locked parallel each other by the limiter means in the operating condition of the collapsible support structure.

12. A collapsible cable regulator assembly comprising, in combination:

a) a collapsible support structure comprising
an elongate lateral member,
an elongate first swing arm having a free end and a mounted end which is pivotably mounted at a first pivot point to the lateral member,
a second swing arm having a free end and a mounted end which is pivotably mounted to the lateral member at a second pivot point which is laterally spaced from the first pivot point,
limiter means for correctly positioning the first and second swing arms relative the lateral member in the operating condition, comprising a first bi-fold bracket between the first swing arm and the lateral member, and a second bi-fold bracket between the second swing arm and the lateral member, and
cable guide means, including a first cable return at the free end of the first swing arm and a second cable return at the free end of the second swing arm, the collapsible support structure being openable from a collapsed condition in which the first and second swing arms each is at an acute angle to the lateral member to an operating condition in which the swing arm is at an operating angle to the lateral member which is greater than the acute angle; and b) a regulator cable mounted to the collapsible support structure.

13. A collapsible cable regulator assembly for controlling a moveable windowpane to open and close a window opening in a motor vehicle door, the regulator assembly comprising a collapsible support structure having a collapsed condition and an operating condition, comprising:
an elongate lateral member having a first pivot mounting point at a first end and a second pivot mounting point at a second end opposite the first end;
an elongate first swing arm pivotably mounted to the lateral member at the first pivot mounting point and extending to a free end, having a first cable return at the free end and a longitudinally extending first glider guide; and
an elongate second swing arm pivotably mounted to the lateral member at the second pivot mounting point and extending to a free end, having a second cable return at the free end and a longitudinally extending second glider guide, the first and second swing arms being pivotable about the first and second pivot mounting points, respectively, from a collapsed position approximately parallel the lateral member to an operating position in which they are parallel each other and substantially perpendicular to the lateral member;

a cable drive drum rotatably mounted at the lateral member;

a first pair of cable guides proximate the first pivot mounting point;

a second pair of cable guides proximate the second pivot mounting point;

a regulator cable extending around the first and second cable returns from driven engagement with the cable drive drum, with turning points at the first pair of cable guides and at the second pair of cable guides;

a first glider attached to the regulator cable for driven travel along the first glider guide, having attachment means for attachment to the window pane;

a second glider attached to the regulator cable for driven travel along the second glider guide, having attachment means for attachment to the window pane; and cable tensioning means for taking up slack in the regulator cable.

14. The collapsible cable regulator assembly for controlling a moveable windowpane to open and close a window opening in a motor vehicle door in accordance with claim 13, further comprising an electric motor mounted to the lateral member and having a reversibly driven output member operatively connected to the cable drive drum.

15. The collapsible cable regulator assembly for controlling a moveable windowpane to open and close a window opening in a motor vehicle door in accordance with claim 13 wherein at least one of the cable guides is mounted for movement between a first position and a second position, and the cable tensioning means comprises a spring biasing the one cable guide toward the second position.

16. The collapsible cable regulator assembly for controlling a moveable windowpane to open and close a window opening in a motor vehicle door in accordance with claim 15 wherein the first and second cable returns and the first and second pairs of cable guides are all pulleys.

17. The collapsible cable regulator assembly for controlling a moveable windowpane to open and close a window opening in a motor vehicle door in accordance with claim 16 wherein a) the front cable return is a free-wheeling pulley mounted for rotation in a plane substantially perpendicular to the plane of the U-shaped cable support structure, b) the front cable guides are free-wheeling pulleys in approximate vertical alignment with the front cable return and have a common axis of rotation which is substantially normal to the plane of the U-shaped cable support structure, c) the rear cable return is a free-wheeling pulley mounted for rotation in a plane substantially perpendicular to the U-shaped cable support structure, and d) the rear cable guides are free-wheeling pulleys in approximate vertical alignment with the rear cable return and have a common axis of rotation which is substantially normal to the plane of the U-shaped cable support structure.

18. The collapsible cable regulator assembly for controlling a moveable windowpane to open and close a window opening in a motor vehicle door in accordance with claim 13 wherein the first and second gliders each is fixedly mounted to a windowpane.

19. A method of installing a cable regulator assembly into a cavity of a motor vehicle door for controlling a moveable window pane to open and close a window opening, the method comprising the steps of:

a) inserting into the cavity through an access opening in the motor vehicle door a cable regulator assembly which is in a collapsed condition and is openable within the cavity to an operating condition;

b) then opening the cable regulator assembly to the operating condition, and c) then fixedly mounting the cable regulator assembly to the motor vehicle door and attaching the window pane to the cable regulator assembly wherein opening the cable regulator assembly to the operating condition comprises swinging an elongate first swing arm, which is pivotably mounted at a first pivot mounting point to a lateral member, in a clockwise direction to an operating position from a collapsed position in which it is at an acute angle to the lateral member, and swinging an elongate second swing arm, which is pivotably mounted to the lateral member at a second pivot mounting point laterally spaced from the first pivot mounting point, in a counter-clockwise direction to an operating position from a collapsed position in which it is at an acute angle to the later member, releasably locking the first and second swing arms parallel each other in the operating condition by limiter means for correctly angling the first and second swing arms relative the lateral member.

20. A method of installing a window regulator assembly into a cavity of a motor vehicle door for controlling a moveable window pane to open and close a window opening, the method comprising the steps of:

a) inserting into the cavity through an access opening in the motor vehicle door a cable regulator assembly which is in a collapsed condition and is openable within the cavity to an operating condition, the cable regulator assembly comprising, in combination:

an elongate lateral member having a first pivot mounting point and a second pivot mounting point laterally spaced form the first pivot mounting point, an elongate first swing arm pivotably mounted to the lateral member at the first pivot mounting point and extending to a free end, having a first cable return pulley at the free end and a longitudinally extending first glider guide, and being positioned at an acute angle to the lateral member;

an elongate second swing arm pivotably mounted to the lateral member at the second pivot mounting point and extending to a free end, having a second cable return pulley at the free end and a longitudinally extending second glider guide, and being positioned at an acute angle to the lateral member;

a cable drive drum operatively connected to a reversibly rotatable output member of an electric motor mounted to the lateral member;

a first pair of cable guides proximate the first pivot mounting point;

a second pair of cable guides proximate the second pivot mounting point;

a regulator cable extending around the first and second cable returns from driven engagement with the cable drive drum, with turning points at the first pair of cable guides and at the second pair of cable guides;

a first glider attached to the regulator cable for driven travel along the first glider guide, having attachment means for attachment to the window pane;

a second glider attached to the regulator cable for driven travel along the second glider guide, having attachment means for attachment to the window pane; and cable tensioning means for taking up slack in the regulator cable;

b) then moving the first swing arm in a clockwise direction to an operating position in engagement with a first mechanical stop, and moving the second swing arm in a counterclockwise direction to an operating position in engagement with a second mechanical stop; and c) then fixedly mounting the cable regulator assembly to the motor vehicle door, with the lateral member being generally horizontal and the first and second swing arms being parallel each other and extending generally vertically upward from the lateral member, and attaching the window pane to the first and second gliders.

* * * * *